US006443825B2

(12) United States Patent
Schadoffsky et al.

(10) Patent No.: US 6,443,825 B2
(45) Date of Patent: Sep. 3, 2002

(54) SANDING PAD

(75) Inventors: Olaf Schadoffsky, Landsberg (DE); Marcel Aeschlimann, Ligerz; Laurent Torriani, Biel, both of (CH)

(73) Assignee: Hilti Aktiengesellschaft, Schaan (LI)

( * ) Notice: Subject to any disclaimer, the term of this patent is extended or adjusted under 35 U.S.C. 154(b) by 0 days.

(21) Appl. No.: 09/863,734

(22) Filed: May 23, 2001

(30) Foreign Application Priority Data

May 30, 2000 (DE) ..... 100 26 936

(51) Int. Cl.[7] ..... B24B 23/00

(52) U.S. Cl. ..... 451/344; 451/490; 451/523; 451/524; 451/525; 451/913

(58) Field of Search ..... 451/344, 350, 451/354, 490, 495, 507, 514, 523, 524, 525, 913, 456

(56) References Cited

U.S. PATENT DOCUMENTS

| | | | | |
|---|---|---|---|---|
| 567,905 | A | * | 9/1896 | Locke |
| 4,484,419 | A | * | 11/1984 | Freerks |
| 4,831,789 | A | * | 5/1989 | Herbin et al. |
| 5,651,728 | A | * | 7/1997 | Stanzione ..... 451/523 |
| 5,944,586 | A | * | 8/1999 | Sevigny et al. ..... 451/57 |

* cited by examiner

*Primary Examiner*—Eileen P Morgan
(74) *Attorney, Agent, or Firm*—Sidley Austin Brown & Wood, LLP

(57) ABSTRACT

A sanding pad including a holding member (1) connectable with a pressure or vacuum source, a sanding element (3), and a jacket (5) for carrying the sanding element (3) and partially filled with solid particles (12) arranged in bulk.

10 Claims, 2 Drawing Sheets

SANDING PAD

BACKGROUND OF THE INVENTION

1. Field of the Invention

The present invention relates to a sanding pad, in particular, to a sanding pad for sanding uneven surfaces, which includes a holding member connectable with a pressure or vacuum source, and at least partially flexible, sanding means-carrying jacket connectable with the holding member.

2. Description of the Prior Act

Sanding pads of the type described above found a wide application, in particular, for sanding objects having uneven surfaces. The sanding means-carrying flexible jacket insures adaptation of the sanding surface of the sanding pad to the surface of a to-be-ground object. Upon displacement of the sanding pad, the abrasive elements of the sanding means grind away a portion of a surface of a treated object. Dependent on the structure of the sanding means, in particular, on the structure and characteristics of the abrasive elements, the condition, e.g., roughness, of the treated surface can be varied.

A sanding pad of the above-described type is disclosed, e.g., in German Utility Model DE299 00 183 U1. The known sanding pad includes a holding member connectable with a source of compressed air, and a sanding means-carrying jacket connected with the holding member and formed as an air sanding, at least partially flexible, cushion. The sanding means is connected with the jacket by hook-and-loop means, and maybe connected by other releasable connection means. In order to retain temporarily its sanding shape during the sanding process, the jacket includes cast-in steel strips which become stabilized under the action of compressed air. With the known sanding pad, uneven surfaces can be ground without particularly large expenditure of time and force. In addition, there is provided a sanding pad that can be adapted to surfaces having a different geometry.

The drawback of the known sanding pad consists, on one hand, in its not sufficient adaptability because of the use of steel strips and, on the other hand, in increased manufacturing costs associated with the production of a rather complicated jacket.

A further drawback consists in the need for a sufficiently large source of compressed air that should be carried with the sanding pad. This makes the handling of the sanding pad more difficult. Furthermore the use of steel strips does not insure a precise adaptability of the sanding surface of the pad to the surface of the treated object.

Moreover, high air pressure inside the jacket, in particular when the jacket is formed as an air cushion, makes the separation between the holding member and the sanding means more difficult and requires a large expenditure of force by the user for displacing the sanding pad during the sanding process. The more difficult separation between the holding member and the sanding means particularly adversely affects the operation of the sanding pad when it is used with a hand-held power tool such as, e.g., an orbital sander.

Accordingly, an object of the present invention is to provide a sanding pad that can be precisely adapted to a sanded surface.

Another object of the present invention is to provide a sanding pad that can be easily handled and economically produced.

SUMMARY OF THE INVENTION

These and other objects of the present invention, which will become apparent hereinafter, are achieved by providing a sanding pad the jacket of which is partially filled with solid particles arranged in bulk.

The use of solid particles insures a precise adaptation of the sanding surface to surface of the treated object, e.g., the characteristics of the jacket, the volume of the solid particles and/or their density can be varied to meet different requirements. The bulk arrangement of the solid particles insure their flowability and, thus, a precise adaptation of the sanding surface of the filled with solid particles, jacket to the treated surface. By using solid particles having different elastic characteristics, the connection between the sanding means and the holding member can be optimized for different applications. In addition, the use of solid particle enables vacuumization of the jacket. When the holding member is connected with a vacuum source, the air is aspirated from the jacket. Upon aspiration of the air from the jacket, the fictional forces between separate solid particles increases and, therefore, the obtained profiled of the sanding surface becomes substantially stable. Upon increase of air pressure in the jacket to the surrounding air pressure, the jacket again becomes flexible. The degree of rigidity of the sanding pad can be controlled, e.g., by the vacuum level in the jacket. The present invention proved to be particularly advantageous for sanding surfaces having a complicated profile.

Advantageously, the solid particles are formed as cubic or ball-shaped bodies which facilitate their displacement in the jacket. Further, the foregoing shape of the solid particles makes interlocking of separate particles impossible, which prevents the so-called lumpiness of the solid bodies.

Advantageously, the solid particle are formed of polystyrol. The polystyrol insures an economical manufacture of the sanding pad and its handling without any problem.

The jacket is, preferably, at least partially air-impermeable, which insures an optimal vacuumization of the jacket. Dependent an application, a jacket with small air permeability can be used. The jacket can be formed, e.g., of plastics or rubber.

The jacket is advantageously prestressed for temporarily fixing the jacket profile. Upon relieving of the jacket from the prestress, it again becomes flexible and can be adapted to another surface of a treated object. The prestress of the jacket can be effected, e.g., by rolling the jacket up the holding member.

Preferably, the connection of the sanding pad to the pressure or vacuum source includes a filter impermeable for the solid particles. This prevents aspiration of the solid particles from the jacket. If the holding member has a fan, it is used, advantageously as a pressure or vacuum source.

Advantageously, the jacket is covered, at least partially with a sanding means layer. This insures an economical manufacturing of the sanding pad. Another advantage of providing the jacket with a layer of sanding means consists in an increased flexibility of the jacket. This insures a better adaptability of the jacket to a treated surface.

In accordance with a particularly advantageous embodiment of the present invention, the jacket includes connection means for the sanding means-carrying layer. This permits to change the used sanding means, without replacing the entire pad. As connection means, hook-and-loop (VELCRO®) connection means can be used.

Advantageously, the jacket is so formed that is deformable in the region of the sanding means. The remaining portion of the jacket can be used for stabilizing the sanding means.

Advantageously, the jacket is releasably connected with the holding member. This provides for the use of jackets having different characteristics.

The novel features of the present invention, which are considered as characteristic for the invention, are set forth in the appended claims. The invention itself, however, both as to its construction and its mode of operation, together with additional advantages and objects thereof, will be best understood from the following detailed description of preferred embodiments, when read with reference to the accompanying drawings.

BRIEF DESCRIPTION OF THE DRAWINGS

The drawings show.

DEFAILED DESCRIPTION OF THE PREFERRED EMBODIMENT

Figure 1:
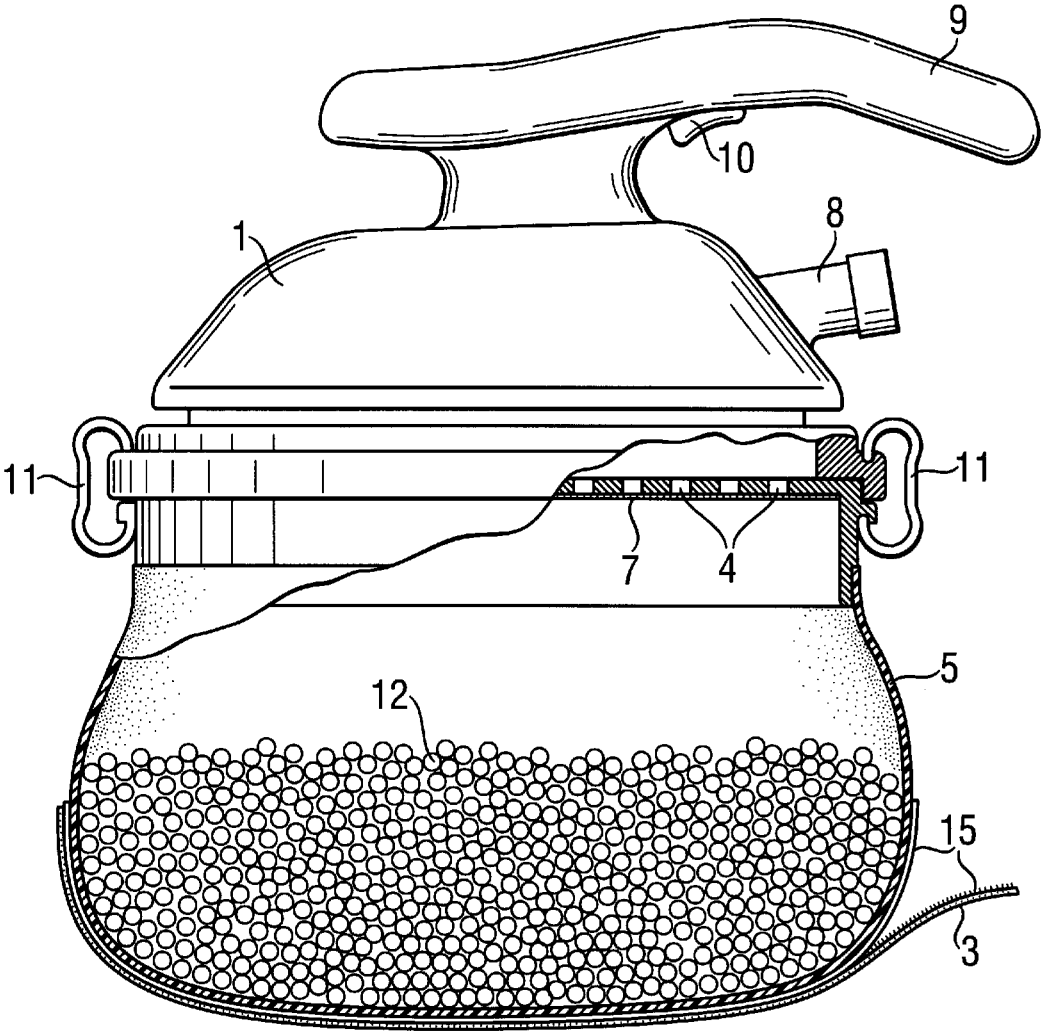
FIG. 1 a perspective, particularly cross-sectional view of a sanding pad with jacket in a flexible condition.
Figure 2:
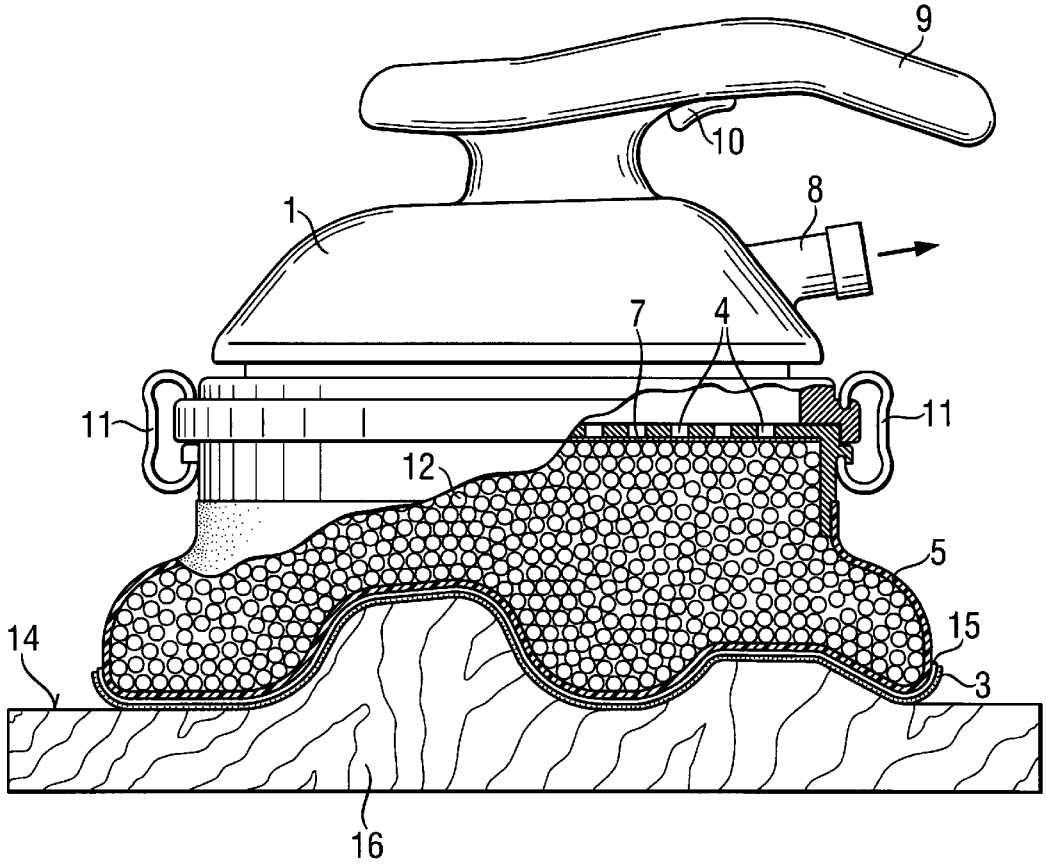
FIG. 2 a view similar to that of FIG. 1 but with the jacket in a rigid condition.

A portable sander according to the present invention, which is shown in FIGS. 1–2, includes a holding member 1, a flexible jacket 5, and a sanding element 3.

The holding member 1 has a suction union 8 connectable with a pressure or vacuum source (not shown). To insure a better guidance of the sanding pad, the holding member 1 is provided with a handle 9 equipped with an actuation member 10 for actuating, e.g., an electric motor that drives the sanding pad.

The jacket 5 is freely suspended from holding member 1 and is releasably connected, at its side remote from the sanding element 3, with the holding member 1. The releasable connection of the jacket 5 with the holding member 1 is effected with a spring member 11. A sieve-like filter 7 is provided between the holding member 1 and the jacket 5, closing an opening 4 there between. The filter 7 is impermeable for solid particles 12 contained in the jacket 5, preventing their penetration through the opening 4. The sanding element 3 is releasably connected with the jacket 5 by a hook-and-loop (VELCRO®) fastener 15.

During the sanding process, the sanding pad is placed with the surface of the jacket 5, which is provided with the sanding element 3, on a surface 14 of a treated object 16, e.g., a wood board. Under the pressure of solid particles 12, the treating surface of the jacket 5 is adapted to the profile of the treated surface 14. When the jacket 5 is subjected to the action of vacuum, the solid particles 12 become packed in the jacket 5, providing the jacket 5 with a rigid profile, as shown in FIG. 2. When the vacuum source (not shown) is disconnected or is shut out, the pressure difference between the jacket 5 and the environment is equalized, and the jacket 5 returns to its flexible condition.

Though the present invention was shown and described with references to the preferred embodiments, such are merely illustrative of the present invention and are not to be construed as a limitation thereof, and various modifications of the present invention will be apparent to those skilled in the art. It is, therefore, not intended that the present invention be limited to the disclosed embodiments or details thereof, and the present invention includes all variations and/or alternative embodiments within the spirit and scope of the present invention as defined by the appended claims.

What is claimed is:

1. A portable sander for sanding planar surfaces having an uneven profile, comprising a holding member (1) connectable with one of a pressure source and a vacuum source; sanding means (3); and a flexible jacket (5) freely suspended from said holding member for carrying the sanding means (3); said jacket being partially filled with solid particles (12) arranged in bulk.

2. A sanding pad according to claim 1, wherein the solid particles have one of cubic shape and ball shape.

3. A sanding pad according to claim 1, wherein the solid particles are formed of polystyrol.

4. A sanding pad according to claim 1, wherein the jacket is at least partially air-permeable.

5. A sanding pad according to claim 1, wherein the jacket is prestressed.

6. A sanding pad according to claim 1, further comprising a solid particle impermeable filter (7) provided between the jacket (5) and the holding member (1).

7. A sanding pad according to claim 1, wherein the jacket (5) is covered, at least partially, with a layer formed of the sanding means (3).

8. A sanding pad according to claim 7, wherein the jacket (5) includes connection means for a sanding means-containing layer.

9. A sanding pad according to claim 1, wherein the jacket (5) is deformable in region of the sanding means (3).

10. A sanding pad according to claim 1, further comprising means (11) for releasable connecting the jacket (5) with the holding member (1).

* * * * *